US009986834B1

(12) United States Patent
Chen

(10) Patent No.: US 9,986,834 B1
(45) Date of Patent: Jun. 5, 2018

(54) STRUCTURE OF RECEPTION CHAIR

(71) Applicant: Hsin-Hua Chen, Kaohsiung (TW)

(72) Inventor: Hsin-Hua Chen, Kaohsiung (TW)

( * ) Notice: Subject to any disclaimer, the term of this patent is extended or adjusted under 35 U.S.C. 154(b) by 0 days. days.

(21) Appl. No.: 15/441,268

(22) Filed: Feb. 24, 2017

(30) Foreign Application Priority Data

Feb. 6, 2017 (TW) ..... 106201745 U

(51) Int. Cl.

| | |
|---|---|
| ***A47C 7/02*** | (2006.01) |
| ***A47C 7/62*** | (2006.01) |
| ***A47C 1/12*** | (2006.01) |
| ***A47C 7/42*** | (2006.01) |

(52) U.S. Cl.
CPC ..... *A47C 1/12* (2013.01); *A47C 7/021* (2013.01); *A47C 7/42* (2013.01)

(58) Field of Classification Search
CPC ..... A47C 4/02; A47C 13/005; A47C 4/03; A47C 4/021; A47C 7/42
USPC ..... 297/440.1, 440.13, 440.14, 440.15, 297/440.16, 440.23, 440.22
See application file for complete search history.

(56) References Cited

U.S. PATENT DOCUMENTS 5,678,890 A * 10/1997 Tenbroeck ..... A47C 3/029 297/271.6
6,149,240 A * 11/2000 Pietrzak ..... A47C 7/02 297/440.1
7,429,084 B2 * 9/2008 Diedrich ..... A47C 4/02 297/440.16
7,537,453 B2 * 5/2009 Morgan ..... A47B 97/00 434/80
7,686,395 B2 * 3/2010 Piretti ..... A47C 7/405 297/297
8,162,396 B2 * 4/2012 Edwards ..... A47C 4/02 297/188.08
8,388,064 B2 * 3/2013 Bertolini ..... A47C 7/445 297/285
2004/0075316 A1 * 4/2004 Ballendat ..... A47C 3/04 297/239
2005/0161990 A1 * 7/2005 Piretti ..... A47C 7/44 297/285
2011/0278889 A1 * 11/2011 Sienkowski ..... A47C 3/00 297/239
2014/0015298 A1 * 1/2014 Xu ..... A47C 4/02 297/440.1
2015/0042135 A1 * 2/2015 Larzelere ..... A47C 7/006 297/239

(Continued)

*Primary Examiner* — Shin H Kim
(74) *Attorney, Agent, or Firm* — Leong C. Lei

(57) ABSTRACT

A reception chair includes a frame assembly, a seat, and a back coupled together. The frame assembly includes front legs, rear legs, and a support coupled to the front and rear legs. The seat is provided, on a front portion of a bottom surface thereof, with collars, which are arranged to respectively correspond to the front legs of the frame assembly so that upper ends of the front legs are insertable and fit into the collars. The seat is provided, on a rear portion of the bottom surface thereof, with fixing sections, such that the fixing sections and the rear legs of the frame assembly correspond to each other, respectively. The fixing sections each include a first mounting member and a second mounting member, such that the fixing sections of the seat and the rear legs collectively form enclosing coupling connection structures therebetween.

9 Claims, 6 Drawing Sheets

(56) References Cited

U.S. PATENT DOCUMENTS

2015/0173512 A1* 6/2015 Li ..... A47C 4/03
297/411.42

* cited by examiner

STRUCTURE OF RECEPTION CHAIR

(a) TECHNICAL FIELD OF THE INVENTION

The present invention relates generally to a structure of a reception chair, and more particularly to a structure of a reception chair that increases supporting power of a frame assembly to improve overall stiffness and strength of the reception chair so as to enhance utilization effectiveness of the reception chair.

(b) DESCRIPTION OF THE PRIOR ART

Visitor's chairs or receptions are often placed outdoors as sitting chairs for guests taking part in an outdoor festival banquet.

As shown in FIG. 1, a conventional reception chair 1 comprises a frame section 11 and a seat section 12. The frame section 11 comprises a pair of left and right front legs 111, a pair of left and right rear legs 112, and a support 113 coupled between the front legs 111 and the rear legs 112. The rear legs 112 are each extended upward to form a back 1121. The seat section 12 is mounted to the support 113 by fastening elements 121. More precisely speaking, the seat section 12 is mounted to a top surface of the support 113, so that the seat section 12 allows for seating by a user, while the back 1121 provides supporting to the back of the user.

The conventional reception chair 1 achieves the purpose of allowing a user to sit thereon with the above-described structural arrangement. However, in the convention reception chair 1, the seat section 12 is mounted to the support 113 by means of fastening elements 121 and the seat section 12 and the frame section 11 are fixed only by the fastening elements 121. This may result in poor security and poor stability of the seat section 12. Further, in the conventional reception chair 1, the front legs 111 and the rear legs 112 are coupled to each other through only the support 113. In other words, the seat section 12 does not provide supporting to the front legs 111 and coupling between the rear legs 112 and the seat section 12. This definitely leads to weakness of the overall structural strength of the reception chair 1 and may cause total collapse in a worse condition.

Thus, it is a challenge of the reception chair manufacturers to provide a structure of a reception chair that helps ensure overall structural stiffness of the reception chair.

SUMMARY OF THE INVENTION

The primary objective of the present invention is to provide a structure of a reception chair, which overcomes the deficiency of a conventional reception chair in respect of insufficiency of overall structural strength.

For such a purpose, the technical solution of the present invention, as provided in the appended claim 1, is to provide a structure of a reception chair, wherein the reception chair comprises a frame assembly, a seat coupled to the frame assembly and a back coupled to the frame assembly and the seat; wherein the frame assembly comprises a pair of left and right front legs, a pair of left and right rear legs, and a support coupled to the front legs and the rear legs; and the seat is provided, on a front portion of a bottom surface thereof, with a pair of left and right collars, and the pair of left and right collars are arranged to respectively correspond to the front legs of the frame assembly so that upper ends of the front legs are insertable and fit into the collars, and the seat is provided, on a rear portion of the bottom surface thereof, with a pair of left and right fixing sections, such that the fixing sections and the rear legs of the frame assembly correspond to each other, respectively, and the fixing sections each comprise a first mounting member and a second mounting member, such that the fixing sections of the seat and the rear legs collectively form enclosing coupling connection structures therebetween.

The effectiveness that the present invention may achieve with the technical solution provided in the appended claim 1 is that the seat and the frame assembly are coupled to each other such that the seat and the support of the frame assembly are kept from each other by a distance so that the seat may serve as an additional bracing or supporting member, whereby the seat forms and serves as an additional supporting member of the frame assembly for supporting and holding the front legs and the rear legs of the support so as to improve structural stiffness of the frame assembly and thus improve overall structural strength of the reception chair to thereby enhance utilization of the reception chair.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIGS. 3A and 3B are enlarged views showing circled portions of FIG. 3.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Firstly, referring to FIGS. 2, 3, 3A, 3B, 4 and 4A, the present invention provides a structure of a reception chair. The reception chair 2 comprises a frame assembly 3, a seat 4 coupled to the frame assembly 3 and a back 5 coupled to the frame assembly 3 and the seat 4.

Figure 1:
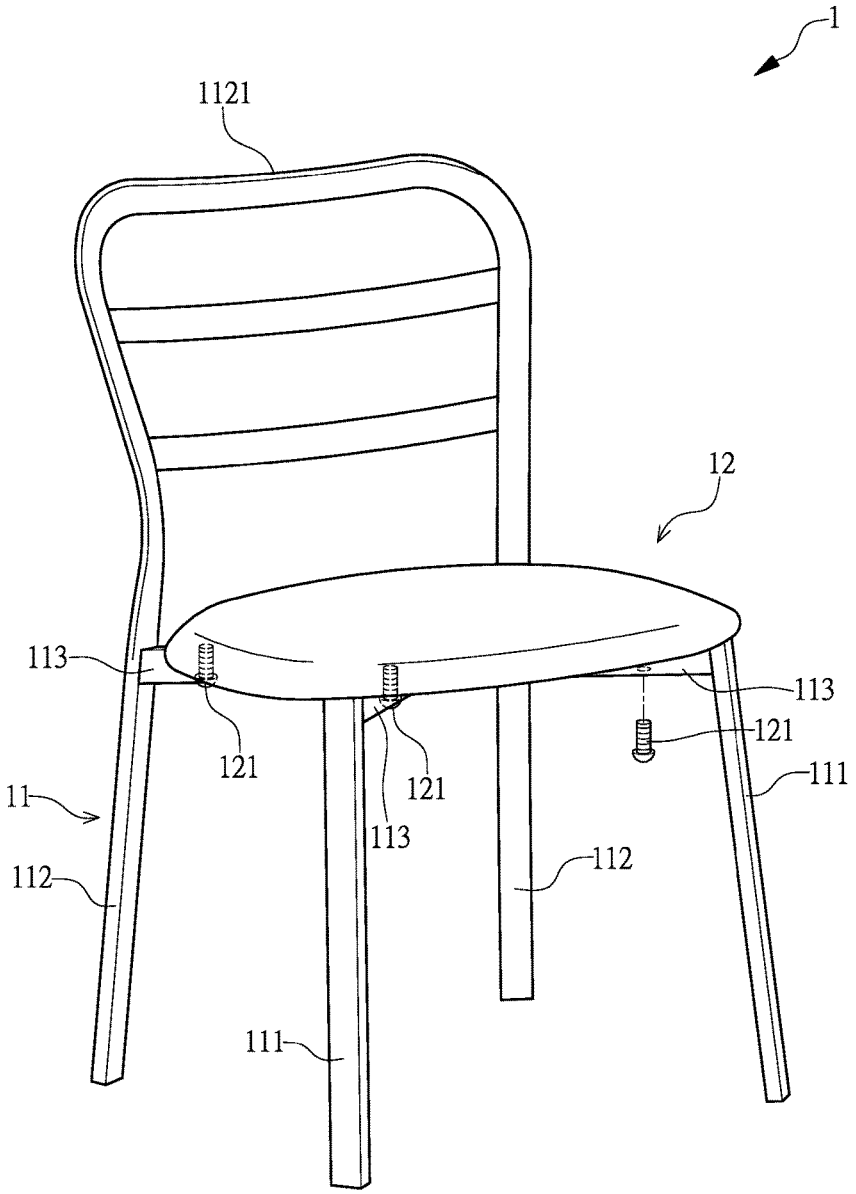
PRIOR ART FIG.1
FIG. 1 is a schematic view showing a conventional reception chair.
Figure 2:
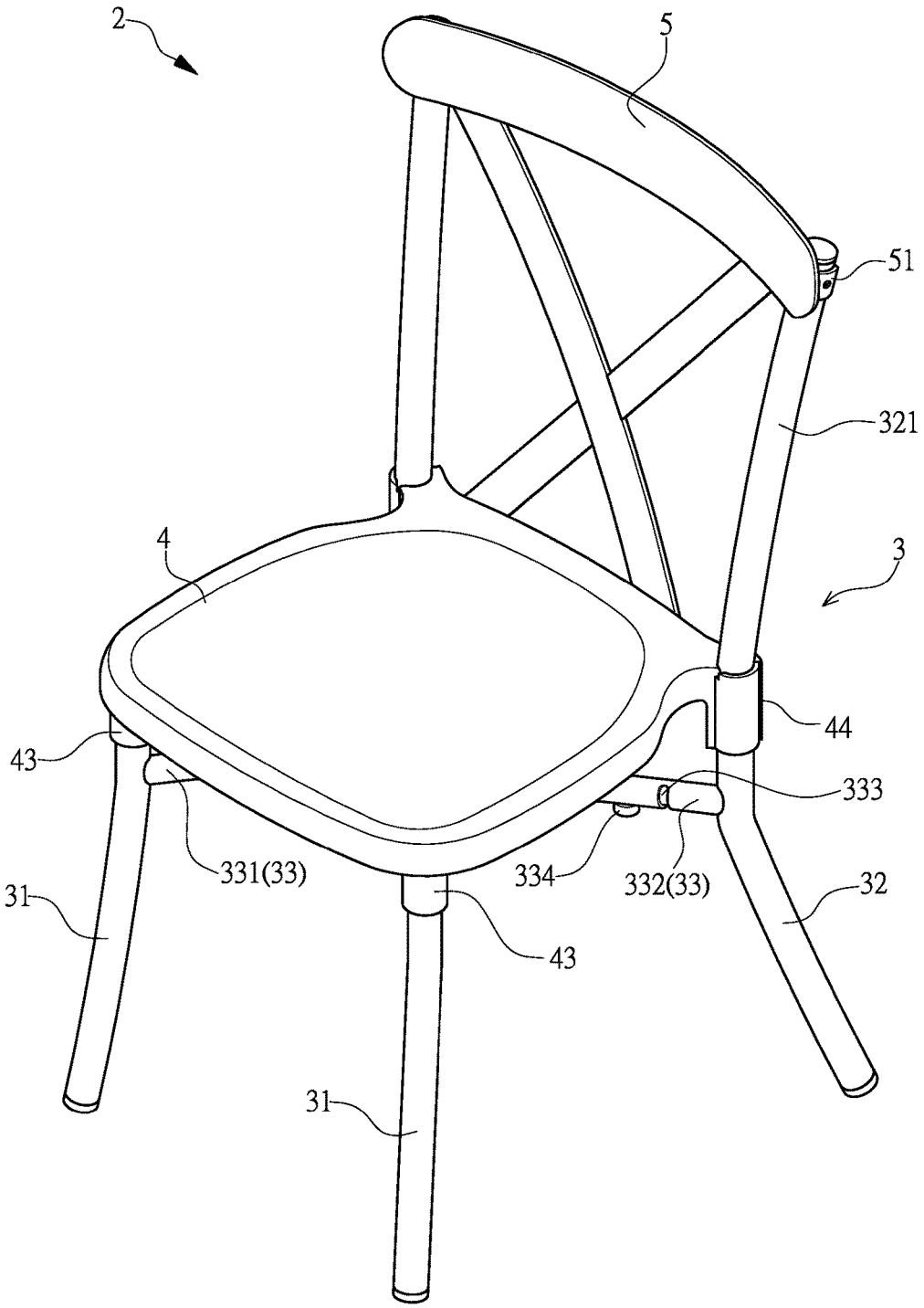
FIG. 2 is a perspective view showing a reception chair according to the present invention.
Figure 3:
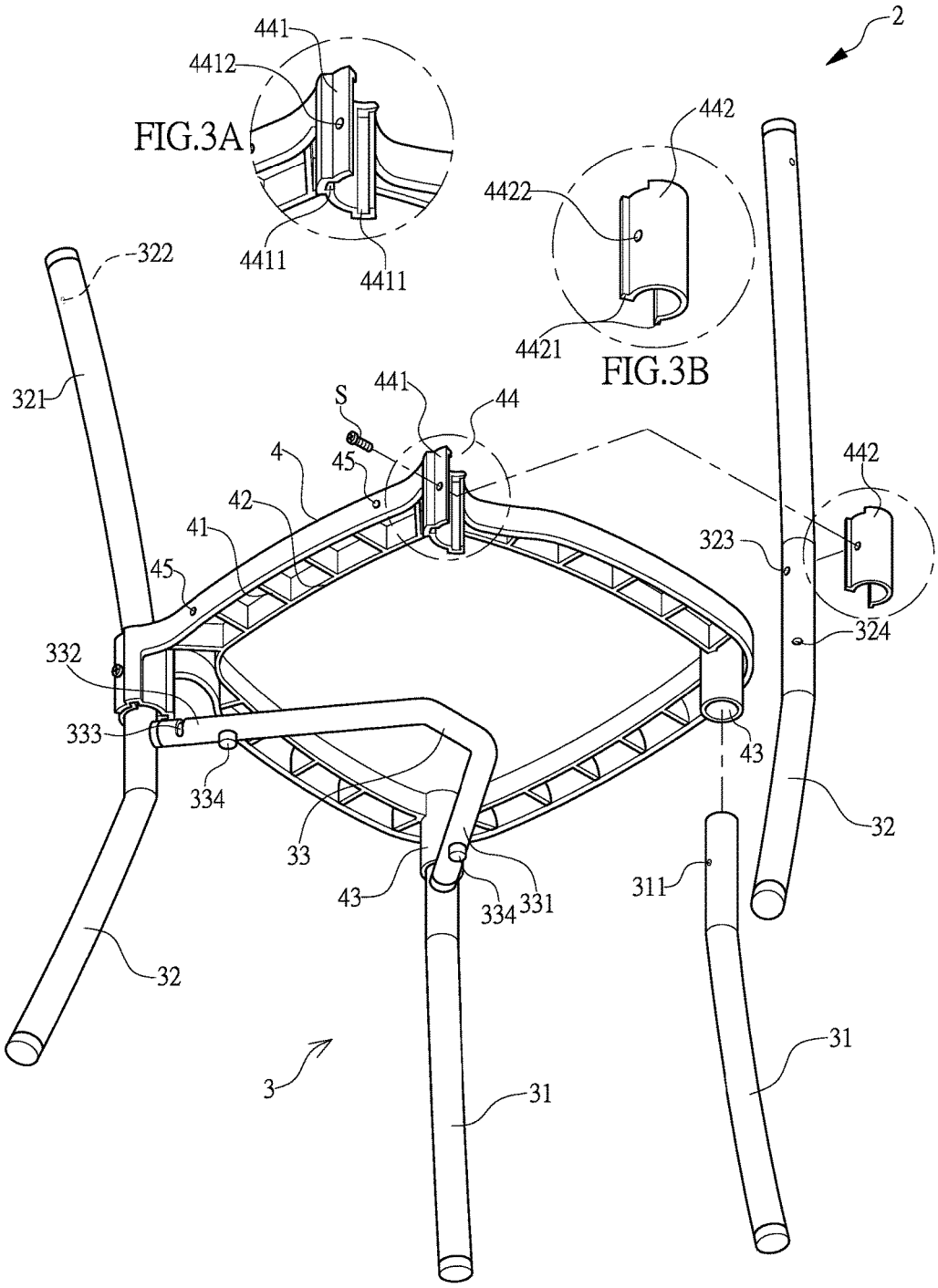
FIG. 3 is an exploded view showing a portion of the reception chair according to the present invention.
Figures 4, 4A:
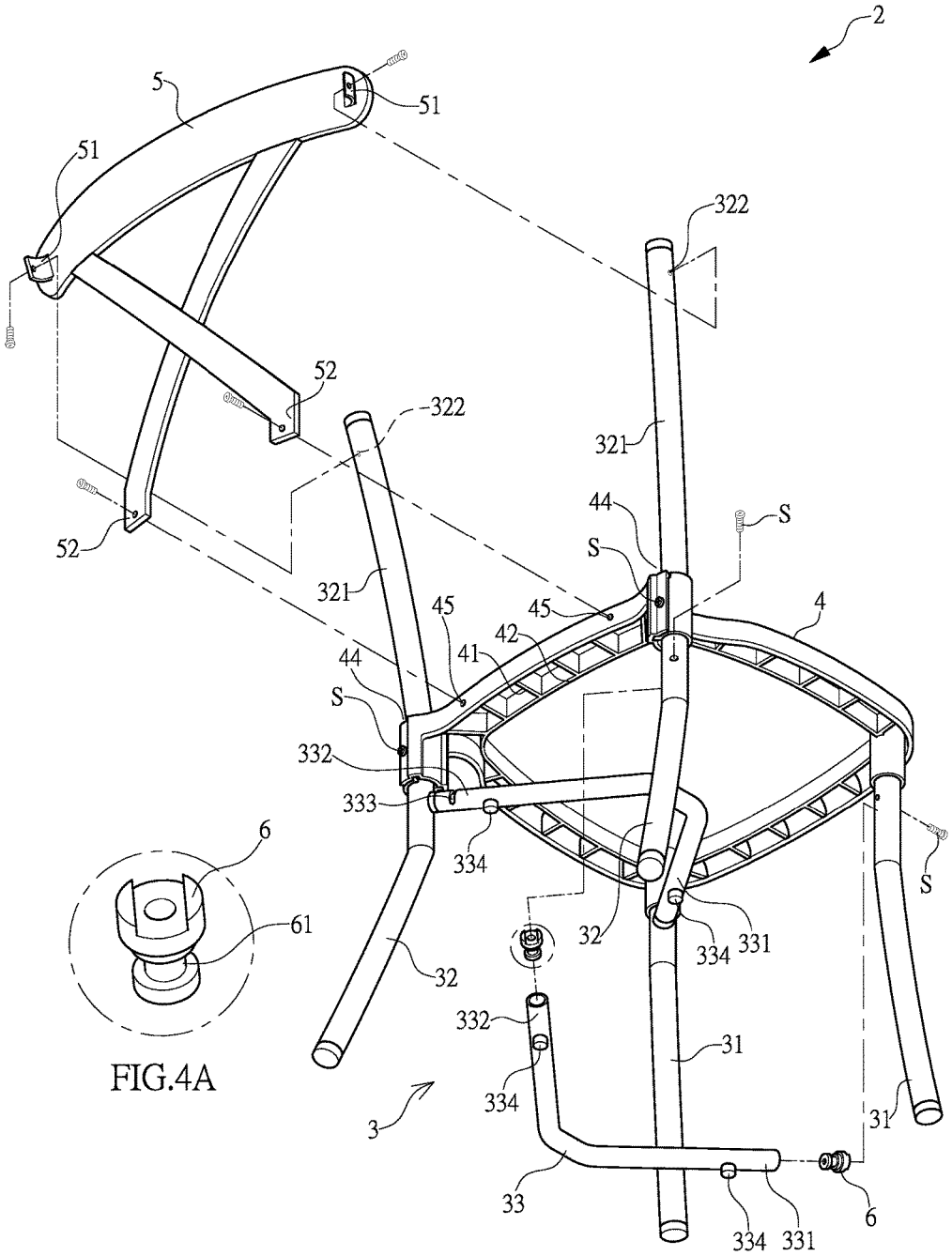
FIG. 4 is an exploded view showing the reception chair according to the present invention, a seat back being included.
FIG. 4A is an enlarged view showing a circled portion of FIG. 4.
Figure 5:
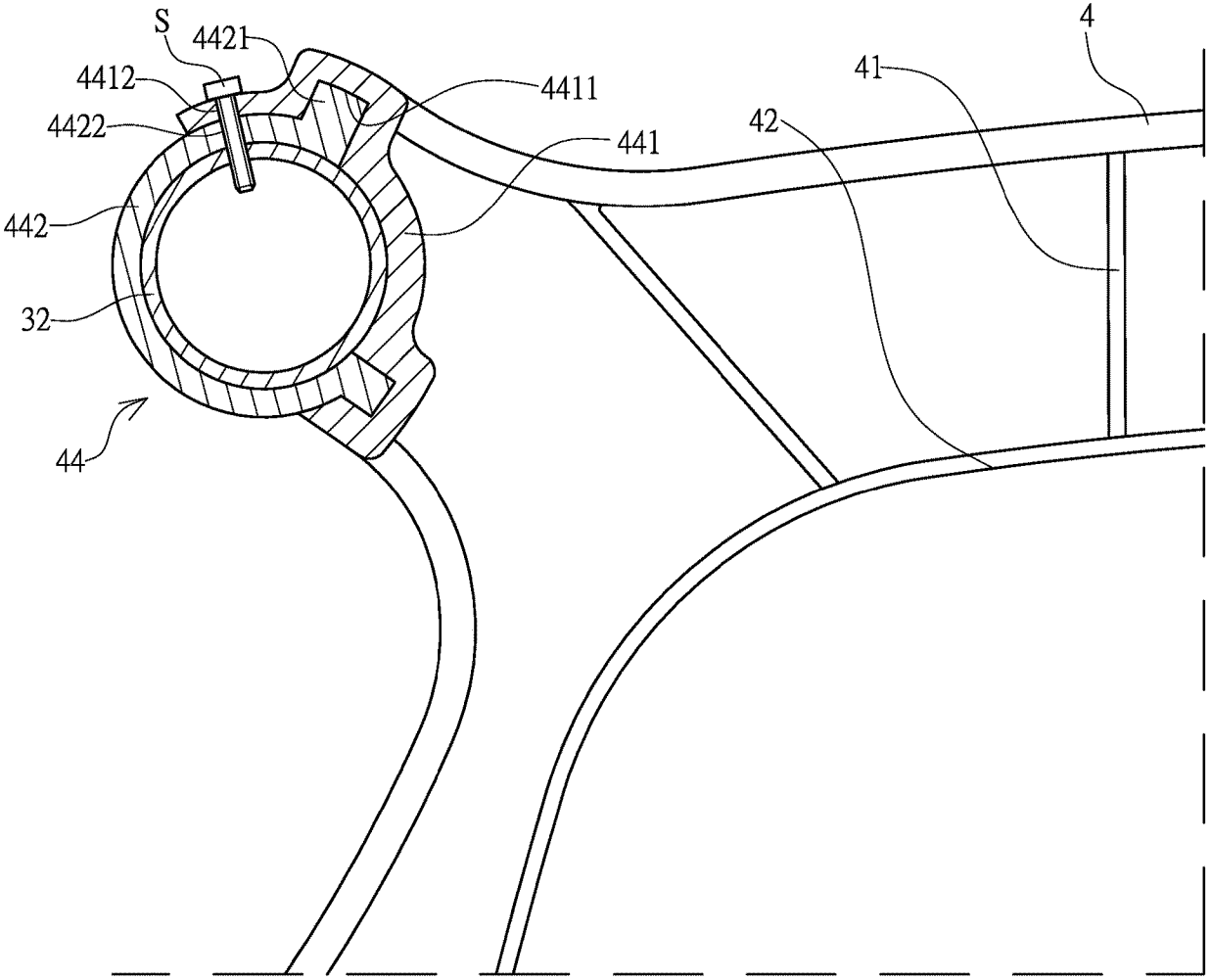
FIG. 5 is a cross-sectional view showing coupling connection between a seat and a rear leg of a frame assembly of the reception chair according to the present invention.

As shown in FIGS. 2, 3, and 4, the frame assembly 3 comprises a pair of left and right front legs 31, a pair of left and right rear legs 32 and a support 33 coupled to the front legs 31 and the rear legs 32. The front legs 31 are arranged in pair and comprise a left one and a right one. The front legs 31 each comprise a front support mounting hole 311 formed therein. The rear legs 32 each comprise an extension section 321 that is extended in an upward direction and the extension section 321 comprises a back fixing hole 322 formed therein. The rear legs 32 are each provided with a seat fixing hole 323 formed therein at a located below the extension section 321 and a rear support mounting hole 324 below the seat fixing hole 323 such that the rear support mounting hole 324 and the front support mounting hole 311 correspond to each other. The support 33 is made, through for example, screwing, welding, or being integrally formed as a unitary structure, in the form of a frame having extensions toward four corners respectively, and the support 33 comprises front leg coupling sections 331 and rear leg coupling sections 332. The front leg coupling sections 331 and the rear leg coupling sections 332 are each provided, in a manner of being embedded therein, a mounting fastener 6, wherein the mounting fastener 6 comprises a recessed annulus section 61. The support 33 comprises a positioning recess 333 formed by recessing each of the front leg coupling sections 331 and the rear leg coupling sections 332 such that the positioning recess 333 is engageable with the recessed annulus section 61 of the mounting fastener 6 corresponding thereto, through being fit therein, and as such, the mounting fasteners can be securely and respectively held in and fixed to the front leg coupling sections 331 and the rear leg coupling sections 332 of the support 33. Further, the support 33 is provided with separation blocks 334, which are elastic, mounted to the front leg coupling sections 331 and the rear leg coupling sections 332 and the arrangement of the separation blocks 334 protect the reception chair 2 from impact and wear, when multiple chairs are stacked together.

As shown in FIGS. 2, 3, 4, and 5, the seat 4 is provided on a circumferential edge portion of a bottom surface thereof with a plurality of reinforcement ribs 41, which collectively form a reinforcement annulus section 42. The seat 4 is provided, on a front portion of the bottom surface thereof, with a pair of left and right collars 43, and the pair of left and right collars 43 are arranged to respectively correspond to the front legs 31 of the frame assembly 3 so that upper ends of the front legs 31 are insertable and fit into the collars 43. The seat 4 is provided, on a rear portion of the bottom surface thereof, with a pair of left and right fixing sections 44, such that the fixing sections 44 and the rear legs 32 of the frame assembly 3 correspond to each other, respectively. The fixing sections 44 each comprise a first mounting member 441 and a second mounting member 442, wherein the first mounting member 441 is in the form of a semi-cylinder that is formed by integrally extending from a rear end of the seat 4 and the first mounting member 441 comprises two fitting slots 4411 formed therein and the first mounting member 441 comprises a through hole 4412 formed therethrough; and the second mounting member 442 is a separate member in the form of a semi-cylinder that is separate from the seat 4. The first mounting member 441 and the second mounting member 442 are mateable with each other to form cylindrical a mounting assembly. The second mounting member 442 comprises a pair of insertion ribs 4421 formed thereon to respectively correspond to the fitting slots 4411 of the first mounting member 441 and the second mounting member 442 is provided with a through aperture 4422 corresponding to the through hole 4412 of the first mounting member 441. The seat 4 is provided with a pair of left and right back fixing holes 45 formed in a rear side thereof at locations adjacent to the fixing sections 44, respectively.

Figure 6:
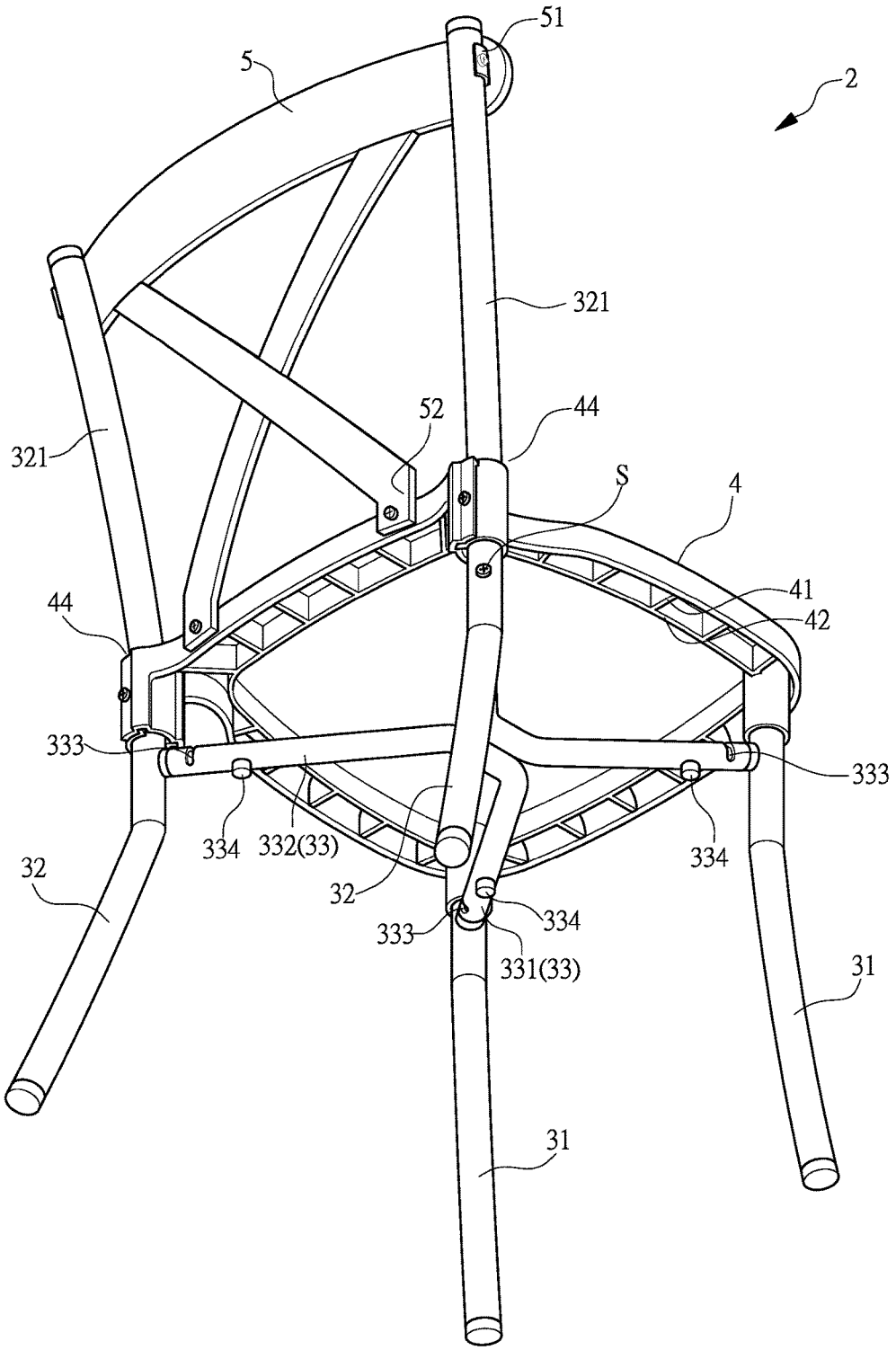
FIG. 6 is a perspective view, taken from a different angle, showing the reception chair according to the present invention.

As shown in FIGS. 4 and 6, the back 5 comprises a horizontal strip and a crossing assembly of strips, which are all elastic. The back 5 is provided, on an upper portion of a rear surface thereof, with upper fixing holes 51, such that the upper fixing hole 51 are respectively fixable to the back fixing holes 322 of the rear legs 32 of the frame assembly 3. A lower portion of the back 5 is fixable to the back fixing holes 45 of the seat 4.

As shown in FIGS. 2, 3, 4, 5, and 6, to embody the reception chair 2 according to the present invention, firstly, the mounting fasteners 6 are respectively inserted into and thus embedded and positioned in the front leg coupling sections 331 and the rear leg coupling sections 332 of the support 33. Threading fastener S are respectively screwed through the front support mounting holes 311 of the front legs 31 and the rear support mounting holes 324 of the rear legs 32 into the mounting fasteners 6 so as to establish coupling connection between the support 33 and the front and rear legs 31, 32 and thus complete the assembling of the frame assembly 3. After the assembly of the frame assembly 3, the seat 4 is fit to the upper ends of the front legs 31 of the frame assembly 3 with the collars 43 thereof, such that the first mounting members 441 of the fixing sections 44 on the rear end of the seat 4 are positioned on the rear legs 32 of the frame assembly 3. Then, the insertion ribs 4421 of the second mounting members 442 are respectively fit into and thus received in the fitting slots 4411 of the first mounting members 441 so that the first mounting members 441 and the second mounting members 442 respectively form the fixing sections 44 enclosing the rear legs 31 of the frame assembly 3, respectively. Under this condition, threading fasteners S are respectively inserted through the through holes 4412 of the first mounting members 441 and the through apertures 4421 of the second mounting members 442 to allow the threading fasteners S to screw into the seat fixing hole 323 of the rear legs 31 of the frame assembly 3. As such, the front portion of the seat 4 is mounted to and supported by the front legs 31 of the frame assembly 3, while the rear portion of the seat 4 is mounted to and supported by the rear legs 32 of the frame assembly 3, with the rear portion of the seat 4 forming an enclosing coupling connection structure with respect to the rear legs 32 of the frame assembly 3, so as to provide a secured connection arrangement between the seat 4 and the frame assembly 3. Further, after the connection of the seat 4 and the frame assembly 3, the seat 4 is set at a distance from the support 33 of the frame assembly 3 so that the seat 4 itself serves as a supporting or bracing member, which helps further improve structural stiffness of the frame assembly 3 and thus improve the overall structural strength of the reception chair 2. After the connection of the seat 4 and the frame assembly 3, the upper fixing holes 51 of the back 5 are fixed to the back fixing holes 322 of the frame assembly 3 and lower fixing sections 52 of the back 5 are respectively attached to and fixed to the back fixing holes 45 of the seat 4 to complete the assembling of the reception chair 2 according to the present invention.

The effectiveness of the present invention is that the seat 4 is provided with the collars 43 on a front portion thereof and the fixing sections 44 on a rear portion thereof such that the collars 43 are fit over and coupled to upper ends of the front legs 31 of the frame assembly 3, while the fixing sections 44 on the rear side of the seat 4 enclose the rear legs 31 of the frame assembly 3 with threading fastener S securely fixing the fixing sections 4 of the seat 4 to the rear legs 31 of the frame assembly 3. In this way, the front portion of the seat 4 is supported by the front legs 31 of the frame assembly 3, while the rear portion of the seat 4 is securely fixed to the rear legs 32 of the frame assembly 3 such that the rear portion of the seat 4 forms an enclosing coupling connection arrangement with respect to each of the rear legs 32 of the frame assembly 3. As such, the seat 4 and the frame assembly 3 collectively form secured and stable coupling therebetween. Further, the seat 4 and the frame assembly 3 are coupled to each other such that the seat 4 and the support 33 of the frame assembly 3 are kept from each other by a distance so that the seat 4 may serve as an additional bracing or supporting member. Specifically speaking, the seat 4 forms and serves as an additional supporting member of the frame assembly 3 for supporting and holding the front legs 31 and the rear legs 32 of the support 3 so as to improve structural stiffness of the frame assembly 3 and thus improve overall structural strength of the reception chair 2 to thereby enhance utilization of the reception chair 2.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A structure of a reception chair, the reception chair comprising a frame assembly, a seat coupled to the frame assembly and a back coupled to the frame assembly and the seat; wherein the frame assembly comprises a pair of left and right front legs, a pair of left and right rear legs, and a support coupled to the front legs and the rear legs; and the seat is provided, on a front portion of a bottom surface thereof, with a pair of left and right collars, and the pair of left and right collars are arranged to respectively correspond to the front legs of the frame assembly so that upper ends of the front legs are insertable and fit into the collars, and the seat is provided, on a rear portion of the bottom surface thereof, with a pair of left and right fixing sections, such that the fixing sections and the rear legs of the frame assembly correspond to each other, respectively, and the fixing sections each comprise a first mounting member and a second mounting member, such that the fixing sections of the seat and the rear legs collectively form enclosing coupling connection structures therebetween.

2. The structure of the reception chair according to claim 1, wherein the front legs are arranged in pair and comprise a left front leg and a right front leg, the front legs each comprising a front support mounting hole formed therein, the rear legs each comprising an extension section that is extended in an upward direction, the extension section comprising a back fixing hole formed therein, the rear legs being each provided with a seat fixing hole formed therein at a located below the extension section and a rear support mounting hole below the seat fixing hole such that the rear support mounting hole and the front support mounting hole correspond to each other; and the support comprises front leg coupling sections and rear leg coupling sections and the front leg coupling sections and the rear leg coupling sections are each provided, in a manner of being embedded therein, a mounting fastener.

3. The structure of the reception chair according to claim 2, wherein the mounting fasteners each comprises a recessed annulus section, and the support comprises a positioning recess formed by recessing each of the front leg coupling sections and the rear leg coupling sections such that the positioning recess is engageable with the recessed annulus section of the mounting fastener corresponding thereto, through being fit therein.

4. The structure of the reception chair according to claim 2, wherein the support is provided with separation blocks, which are elastic, mounted to the front leg coupling sections and the rear leg coupling sections.

5. The structure of the reception chair according to claim 1, wherein the seat is provided on a circumferential edge portion of a bottom surface thereof with a plurality of reinforcement ribs, which collectively form a reinforcement annulus section; the seat is provided, on a front portion of a bottom surface thereof, with a pair of left and right collars, and the pair of left and right collars are arranged to respectively correspond to the front legs of the frame assembly; the seat is provided, on a rear portion of the bottom surface thereof, with a pair of left and right fixing sections, such that the fixing sections and the rear legs of the frame assembly correspond to each other, respectively; and the seat is provided with a pair of left and right back fixing holes formed in a rear side thereof at locations adjacent to the fixing sections 44, respectively.

6. The structure of the reception chair according to claim 4, wherein the fixing sections each comprise a first mounting member and a second mounting member, wherein the first mounting member is in the form of a semi-cylinder that is formed by integrally extending from a rear end of the seat and the first mounting member comprises two fitting slots formed therein and the first mounting member comprises a through hole formed therethrough; and the second mounting member is a separate member in the form of a semi-cylinder that is separate from the seat, the first mounting member and the second mounting member being mateable with each other to form cylindrical a mounting assembly, the second mounting member comprising a pair of insertion ribs formed thereon to respectively correspond to the fitting slots of the first mounting member, the second mounting member being provided with a through aperture corresponding to the through hole of the first mounting member.

7. The structure of the reception chair according to claim 1, wherein the back is provided, on an upper portion of a rear surface thereof, with upper fixing holes, such that the upper fixing hole are respectively fixable to the back fixing holes of the rear legs of the frame assembly; and a lower portion of the back is fixable to the back fixing holes of the seat.

8. The structure of the reception chair according to claim 7, wherein the back comprises a horizontal strip and a crossing assembly of strips, which are elastic.

9. The structure of the reception chair according to claim 1, wherein the seat and the frame assembly are coupleable to each other such that the seat and the support of the frame assembly are spaced from each other by a predetermined distance so that the seat functions additionally as a supporting member, wherein the seat supports and holds the front legs and the rear legs of the frame assembly.

* * * * *